US011315582B2

(12) United States Patent
Liu et al.

(10) Patent No.: US 11,315,582 B2
(45) Date of Patent: Apr. 26, 2022

(54) METHOD FOR RECOVERING AUDIO SIGNALS, TERMINAL AND STORAGE MEDIUM

(71) Applicant: GUANGZHOU KUGOU COMPUTER TECHNOLOGY CO., LTD., Guangzhou (CN)

(72) Inventors: Jiaze Liu, Guangzhou (CN); Yufei Wang, Guangzhou (CN)

(73) Assignee: GUANGZHOU KUGOU COMPUTER TECHNOLOGY CO., LTD., Guangzhou (CN)

( * ) Notice: Subject to any disclaimer, the term of this patent is extended or adjusted under 35 U.S.C. 154(b) by 193 days.

(21) Appl. No.: 16/627,079

(22) PCT Filed: Nov. 27, 2018

(86) PCT No.: PCT/CN2018/117766

§ 371 (c)(1),
(2) Date: Dec. 27, 2019

(87) PCT Pub. No.: WO2020/052088

PCT Pub. Date: Mar. 19, 2020

(65) Prior Publication Data

US 2020/0265848 A1 Aug. 20, 2020

(30) Foreign Application Priority Data

Sep. 10, 2018 (CN) ..... 2018110530500.0

(51) Int. Cl.
*G10L 19/022* (2013.01)
*G10L 19/02* (2013.01)
*G10L 21/0388* (2013.01)

(52) U.S. Cl.
CPC ..... *G10L 19/0204* (2013.01); *G10L 19/0212* (2013.01); *G10L 21/0388* (2013.01)

(58) Field of Classification Search
USPC ..... 704/200–232, 500–504
See application file for complete search history.

(56) References Cited

U.S. PATENT DOCUMENTS 5,530,750 A * 6/1996 Akagiri ..... G11B 20/10527 704/500
5,654,952 A * 8/1997 Suzuki ..... G10L 19/02 369/59.16

(Continued)

FOREIGN PATENT DOCUMENTS

CN 1294782 A 5/2001
CN 1402592 A 3/2003

(Continued)

OTHER PUBLICATIONS

CNIPA, "Office Action Re Chinese Patent Application No. 201711436811.6", dated May 5, 2019, p. 11, Published in: CN.

(Continued)

*Primary Examiner* — Jesse S Pullias
(74) *Attorney, Agent, or Firm* — Neugeboren O'Dowd PC

(57) ABSTRACT

A method for recovering audio signals, a terminal and a storage medium are provided. The method includes: buffering an audio signal sampled at a preset number of sampling points each time, and then performing frequency spectrum analysis on the sampled audio signal by FFT; when it is determined that the audio signal is compressed, filtering a frequency point; recovering high-frequency signals based on audio signals before the frequency point; and performing phase recovery on the high-frequency signals. Thus, compressed high-frequency signals in the audio signals may be recovered.

18 Claims, 5 Drawing Sheets

(56) References Cited

U.S. PATENT DOCUMENTS

| | | | | |
|---|---|---|---|---|
| 5,999,899 | A * | 12/1999 | Robinson | H04B 1/665 704/219 |
| 6,826,526 | B1 * | 11/2004 | Norimatsu | G10L 19/038 704/222 |
| 7,243,073 | B2 | 7/2007 | Veh et al. | |
| 2002/0016698 | A1 | 2/2002 | Tokuda | |
| 2002/0159607 | A1 | 10/2002 | Ford et al. | |
| 2008/0109215 | A1 | 5/2008 | Liu et al. | |
| 2009/0185693 | A1 | 7/2009 | Johnston et al. | |
| 2009/0271204 | A1 * | 10/2009 | Tammi | G10L 19/0208 704/500 |
| 2010/0017205 | A1 * | 1/2010 | Visser | G10L 21/02 704/225 |
| 2012/0323582 | A1 * | 12/2012 | Peng | G10L 19/24 704/500 |
| 2016/0329061 | A1 | 11/2016 | Heber et al. | |
| 2017/0272863 | A1 | 9/2017 | Mentz | |
| 2017/0337926 | A1 * | 11/2017 | Chon | G10L 21/038 |
| 2020/0112812 | A1 | 4/2020 | Liu | |

FOREIGN PATENT DOCUMENTS

| | | | |
|---|---|---|---|
| CN | 1753312 | A | 3/2006 |
| CN | 1791285 | A | 6/2006 |
| CN | 1975860 | A | 6/2007 |
| CN | 101093670 | A | 12/2007 |
| CN | 101512639 | A | 8/2009 |
| CN | 101645268 | A | 2/2010 |
| CN | 101695151 | A | 4/2010 |
| CN | 101878416 | A | 11/2010 |
| CN | 105900170 | A | 11/2010 |
| CN | 101902679 | A | 12/2010 |
| CN | 102124517 | A | 7/2011 |
| CN | 102177545 | A | 9/2011 |
| CN | 102568470 | A | 7/2012 |
| CN | 102883245 | A | 1/2013 |
| CN | 103116882 | A | 5/2013 |
| CN | 103237287 | A | 8/2013 |
| CN | 103377655 | A | 10/2013 |
| CN | 103632678 | A | 3/2014 |
| CN | 104103279 | A | 10/2014 |
| CN | 104132685 | A | 11/2014 |
| CN | 104464725 | A | 3/2015 |
| CN | 104541327 | A | 4/2015 |
| CN | 104581602 | A | 4/2015 |
| CN | 104977582 | A | 10/2015 |
| CN | 105788612 | A | 7/2016 |
| CN | 104091601 | A | 8/2016 |
| CN | 105869621 | A | 8/2016 |
| CN | 105872253 | A | 8/2016 |
| CN | 106652986 | A | 5/2017 |
| CN | 107040862 | A | 8/2017 |
| CN | 107077849 | A | 8/2017 |
| CN | 107863095 | A | 3/2018 |
| CN | 108156561 | A | 6/2018 |
| CN | 108156575 | A | 6/2018 |
| CN | 109036457 | A | 12/2018 |
| WO | 2015145660 | | 4/2017 |
| WO | 2017165968 | A1 | 10/2017 |

OTHER PUBLICATIONS

Chao, Wang, "The Study of Virtual Multichannel Surround Sound Reproduction Technology", "Dissertation Submitted to Shanghai Jiao Tong University for the Degree of Master", Jan. 2009, p. 79, Published in: CN.

CNIPA, "Office Action Regarding Chinese Patent Application No. 20171142680.4", dated Mar. 11, 2019, p. 13, Published in: CN.

International Searching Authority, "International Search Report and Written Opinion Re PCT/CN2018/115928", dated Dec. 19, 2018, p. 19, Published in: CN.

International Searching Authority, "International Search Report and Written Opinion Re PCT/CN2018/118764", dated Jan. 23, 2019, p. 17, Published in: CN.

International Searching Authority, "International Search Report and Written Opinion Re PCT/CN2018/118766", dated Jan. 14, 2019, p. 18, Published in: CN.

PCT, "International Search Report and Written Opinion Regarding International Application No. PCT/CN2018/117766", dated Jun. 11, 2019, p. 21, Published in: CN.

Zhao, Yi et al., "Multi-Channel Audio Signal Retrieval Based On Multi-Factor Data Mining With Tensor Decomposition", "Proceedings of the 19th International Conference on Digital Signal Processing", dated Aug. 20, 2014, p. 5.

CNIPA, "First Office Action of Chinese Application No. 201811053050.0", dated Jul. 23, 2020, p. 20, Published in: CN.

Tilp, Jan, "Supplementary European Search Report Regarding European Application No. 189923758.9", dated Aug. 12, 2020, p. 11, Published in: DE.

Gampp et al., "Methods for Low Bitrate Coding Enhancement Part I: Spectral Restoration", "2017 AES International Conference on Automotive Audio", dated Aug. 29, 2017, p. 8, Publisher: Retrieved from http://www.aes.org/e-lib/inst/download.cfm/19193.pdf?ID=19193.

Tilp, Jan, "Supplementary European Search Report Regarding European Application No. 18923758.9", dated Aug. 12, 2020, p. 11, Published in: DE.

Gampp et al., "Methods for Low Bitrate Coding Enhancement Part I: Spectral Restoration", "2017 AES International Conference on Automotive Audio", Aug. 29, 2017, p. 8, Publisher: Retrieved from http://www.aes.org/e-lib/inst/download.cfm/19193.pdf?ID=19193.

* cited by examiner

METHOD FOR RECOVERING AUDIO SIGNALS, TERMINAL AND STORAGE MEDIUM

CROSS-REFERENCE TO RELATED APPLICATION

This application is a national phase of PCT patent application No.: PCT/CN2018/117766 filed on Nov. 27, 2018, which claims priority to Chinese Patent Application No. 201811053050.0, filed on Sep. 10, 2018 and entitled "METHOD AND APPARATUS FOR RECOVERING AUDIO SIGNALS", the entire contents of which are incorporated herein by reference.

TECHNICAL FIELD

The present disclosure relates to the field of audio technology, and more particularly, relates to a method for recovering audio signals, a terminal and a storage medium.

BACKGROUND

In the audio field, in order to save audio data transmission resources, audio data is generally subjected to low-pass filtering first to filter high-frequency signals that are insensitive to the human auditory system, and the audio data subjected to low-pass filtering is then compressed to increase the compression ratio and reduce the amount of audio data.

SUMMARY

Embodiments of the present disclosure provide a method for recovering audio signals, a terminal and a storage medium.

In a first aspect, a method for recovering audio signals is provided. The method includes:

determining a first frequency point in an audio signal having a high-frequency signal to be recovered by power spectrum scanning, wherein the first frequency point is a frequency point having a minimum frequency of the high-frequency signal to be recovered in the audio signal;

among a plurality of frequency subbands having equal width of the audio signal having the high-frequency signal to be recovered, recovering, according to the audio signal of a previous frequency subband of a target frequency subband, the audio signal of the target frequency subband and the audio signals of the frequency subbands after the target frequency subband in the plurality of frequency subbands, wherein the target frequency subband is a frequency subband to which the first frequency point belongs;

synthesizing the audio signals of the frequency subbands before the target frequency subband in the plurality of frequency subbands, the audio signal of the target frequency subband, and the audio signals of the frequency subbands after the target frequency subband in the plurality of frequency subbands;

separating the synthesized audio signal according to the first frequency point to obtain high-frequency signals and low-frequency signals, and performing phase recovery on the high-frequency signals; and superimposing the high-frequency signals subjected to phase recovery and the low-frequency signals to obtain an audio signal in which the high-frequency signals are recovered.

Optionally, the method further includes:

if the first frequency point is not present in the audio signal having a high-frequency signal to be recovered, converting the audio signal having a high-frequency signal to be recovered into a plurality of frequency subbands having an equal width, and synthesizing the audio signals of the plurality of frequency subbands;

separating the audio signal obtained by synthesizing the audio signals of the plurality of frequency subbands according to a preset third frequency point to obtain high-frequency signals and low-frequency signals; and superimposing the high-frequency signals and the low-frequency signals obtained by separating according to the preset third frequency point to obtain the audio signal in which the high-frequency signals are recovered.

Optionally, separating the synthesized audio signal according to the first frequency point to obtain high-frequency signals and low-frequency signals includes:

performing linear high-pass filtering on the synthesized audio signal to obtain the high-frequency signals, and performing linear low-pass filtering on the synthesized audio signal to obtain the low-frequency signals, wherein a frequency of each of the signals subjected to linear high-pass filtering is greater than or equal to the frequency of the first frequency point, and a frequency of each of the signals subjected to linear low-pass filtering is less than the frequency of the first frequency point.

Optionally, performing phase recovery on the high-frequency signals includes:

performing all-pass biquad infinite impulse response (IIR) filtering on the high-frequency signals to obtain the high-frequency signals subjected to phase recovery.

Optionally, the method further includes:

determining a coefficient of the biquad IIR filtering according to the frequency of the first frequency point and sampling rates.

Optionally, determining a first frequency point in an audio signal having a high-frequency signal to be recovered by power spectrum scanning includes:

buffering an audio signal which is sampled at a preset number of sampling points;

performing fast Fourier transform (FFT) on the sampled audio signal to obtain an FFT result;

according to the FFT result, finding a first frequency point that satisfying preset conditions, wherein the preset conditions are that a difference between frequencies of the first frequency point and a second frequency point is less than a first preset value, a difference between powers of the first frequency point and the second frequency point is greater than a second preset value, a power of a frequency point having a frequency greater than the frequency of the first frequency point is zero, and the frequency of the second frequency point is less than the frequency of the first frequency point.

Optionally, prior to the performing FFT on the sampled audio signal to obtain an FFT result, the method further includes:

windowing the sampled audio signal to obtain audio signal subjected to windowing; and wherein performing FFT on the sampled audio signal to obtain an FFT result includes:

performing the FFT on the audio signal subjected to windowing to obtain the FFT result.

In a second aspect, an apparatus for recovering audio signals is provided. The apparatus includes:

a buffering module, configured to buffer an audio signal sampled at a preset number of sampling points;

a fast Fourier transform (FFT) module, configured to perform FFT on the sampled audio signal to obtain an FFT result;

a converting module, configured to, according to the FFT result, if a first frequency point satisfying preset conditions is present, convert the audio signal sampled at the preset number of sampling points into audio signals of a plurality of frequency subbands having an equal width;

a determining module, configured to determine a target frequency subband to which the first frequency point belongs, wherein the preset conditions are that a difference between frequencies of the first frequency point and a second frequency point is less than a first preset value, a difference between powers of the first frequency point and the second frequency point is greater than a second preset value, a power of a frequency point having a frequency greater than the frequency of the first frequency point is zero, and the frequency of the second frequency point is less than the frequency of the first frequency point;

a recovering module, configured to recover, according to the audio signal of a previous frequency subband of the target frequency subband, the audio signal of the target frequency subband in the plurality of frequency subbands and the audio signals of the frequency subbands after the target frequency subband;

a synthesizing module, configured to synthesize the audio signals of the frequency subbands before the target frequency subband in the plurality of frequency subbands, the audio signal of the target frequency subband, and the audio signals of the frequency subbands after the target frequency subband in the plurality of frequency subbands;

a separating module, configured to separate the synthesized audio signal according to the first frequency point to obtain high-frequency signals and low-frequency signals, wherein the recovery module is further configured to perform phase recovery on the high-frequency signals; and a superimposing module, configured to superimpose the high-frequency signals subjected to phase recovery and the low-frequency signals obtained by separating to obtain sampled audio signal in which the high-frequency signals are recovered.

Optionally, the converting module is further configured to, according to the FFT result, if the first frequency point is not present, convert the audio signal sampled at the preset number of sampling points into a plurality of frequency subbands having an equal width;

the synthesizing module is further configured to synthesize the audio signals of the plurality of frequency subbands;

the separating module is further configured to separate the audio signal obtained by synthesizing the audio signals of the plurality of frequency subbands according to a preset third frequency point to obtain high-frequency signals and low-frequency signals; and the superimposing module is further configured to superimpose the high-frequency signals and the low-frequency signals according to the preset third frequency point to obtain the sampled audio signal.

Optionally, the separating module is configured to:

perform linear high-pass filtering on the synthesized audio signal to obtain the high-frequency signals, and perform linear low-pass filtering on the synthesized audio signal to obtain the low-frequency signals, wherein a frequency of each of the signals subjected to linear high-pass filtering is greater than or equal to the frequency of the first frequency point, and a frequency of each of the signals subjected to linear low-pass filtering is less than the frequency of the first frequency point.

Optionally, the recovering module is configured to:

perform all-pass biquad IIR filtering on the high-frequency signals to obtain high-frequency signals subjected to phase recovery.

Optionally, the determining module is further configured to:

determine a coefficient of the biquad IIR filtering according to the frequency of the first frequency point and sampling rates.

Optionally, the apparatus further includes:

a windowing module, configured to, prior to performing FFT on the sampled audio signal to obtain an FFT result, windowing the sampled audio signal to obtain audio signal subjected to windowing; and the FFT module is configured to:

perform the FFT on the audio signal subjected to windowing to obtain the FFT result.

In a third aspect, a terminal is provided. The terminal includes a memory and a processor, the memory is used to store at least one instruction, and the processor is used to implement any method according the first aspect when executing the at least one instruction.

In a fourth aspect, a non-transitory computer-readable storage medium is provided. The storage medium stores at least one instruction, and the at least one instruction, when being executed by a processor, implements any method according the first aspect.

The technical solutions according to the embodiments of the present disclosure at least achieve the following beneficial effects.

In the embodiments of the present disclosure, in case of an audio with a lossy format, after an audio signal sampled at a preset number of sampling points is buffered each time, the sampled audio signal may be subjected to FFT to obtain an FFT result. According to the FFT result, if a first frequency point satisfying preset conditions is present, the audio signal sampled at the preset number of sampling points are converted into audio signals of a plurality of frequency subbands having an equal width. A target frequency subband including the first frequency point is determined. Then, based on the audio signal of a previous frequency subband of the target frequency subband, the audio signal of the target frequency subband in the plurality of frequency subbands and the audio signals of the frequency subbands after the target frequency subband are recovered. Next, the audio signals of the frequency subbands before the target frequency subband, the audio signal of the target frequency subband, and the audio signals of the frequency subbands after the target frequency subband in the plurality of frequency subbands are synthesized. The synthesized audio signal are separated according to the first frequency point to obtain high-frequency signals and low-frequency signals, and the high-frequency signals are subjected to phase recovery. The high-frequency signals subjected to phase recovery and the low-frequency signals are superimposed to obtain sampled audio signal in which the high-frequency signals are recovered. As such, since the high-frequency signals in the sampled audio signal may be recovered, the sampled audio signal are recovered as well. Therefore, the method for recovering audio signals is provided.

DETAILED DESCRIPTION

The embodiments of the present disclosure will be described in further detail with reference to the attached drawings, to clearly present the objects, technical solutions, and advantages of the present disclosure.

The embodiments of the present disclosure provide a method for recovering audio signals. An execution subject body of the method may be a terminal. The terminal may be a mobile phone, a computer, a tablet computer, or the like.

A processor, a memory, and a transceiver may be configured in the terminal. The processor may be configured to recover audio signals. The memory may be configured to recover desired data and generated data during recovering the audio signals. The transceiver may be configured to receive and transmit data. The terminal may further include an input/output device such as a screen, wherein the screen may be a touch screen. The screen may be configured to display recovered audio signals, and the like.

In the embodiments of the present disclosure, a mobile phone may be, for example, used as the terminal for detailed description of practice of the technical solutions, and other cases are similar and may not be repeated again herein.

Prior to the practice, the application scenario of the embodiments of the present disclosure is first introduced:

In the audio field, in order to save audio data transmission resources, audio data is generally subjected to low-pass filtering first to filter high-frequency signals that are insensitive to the human auditory system, and the audio data subjected to low-pass filtering is then compressed to increase the compression ratio and reduce the amount of audio data. With the development of computer technologies and the improvement of quality of audio digital-to-analog converters and earphones, when the audio data is played, the defects caused by the filtered high-frequency signals become more and more obvious. Therefore, a method for recovering high-frequency signals in the compressed audio signals is desired.

Figure 1:
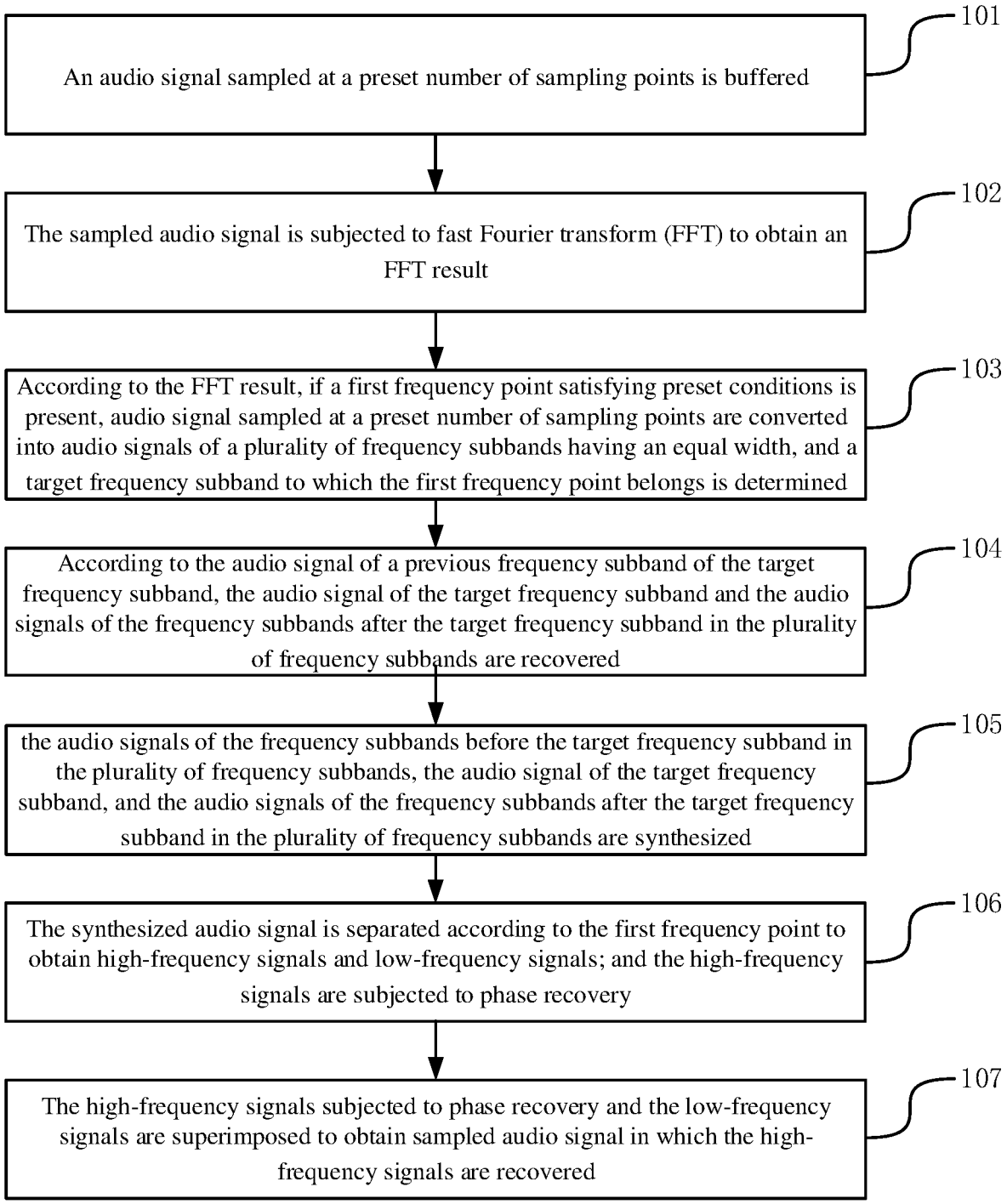
FIG. 1 is a flowchart of a method for recovering audio signals as provided by an embodiment of the present disclosure.

An embodiment of the present disclosure provides a method for recovering audio signals. As shown in FIG. 1, the method may include the following steps.

In step 101, an audio signal sampled at a preset number of sampling points is buffered.

The preset number may be preset and stored in the terminal. The preset number generally ranges from 2048 to 32768, and is equal to $2^N$ (which facilitates the operation of subsequent FFT algorithm), where N is greater than or equal to 11, and less than or equal to 15. For example, the preset number is 8192.

During the practice, after downloading a compressed audio, the terminal may sample audio signals of the compressed audio according to a preset sampling rate. The audio signal sampled at a preset number of sampling points, which are buffered each time, is subjected to subsequent processing as a small block of audio signals.

It should be noted that, in the embodiment of the present disclosure, the longer the audio signal sampled by the sample points, which are buffered each time, the higher the recovery quality. However, the requirements for hardware resources are relatively high, and therefore, the preset number should be selected appropriately, i.e., should be suitable for hardware resources and achieve a better recovery quality.

It should also be noted that the above sampling rate may be 22.05 KHz, 44.1 KHz, or the like. The sampling method may be pulse code modulation (PCM) sampling.

In step 102, the sampled audio signal is subjected to fast Fourier transform (FFT) to obtain an FFT result.

During the practice, upon obtaining a small block of audio signals, the terminal inputs the small block of audio signals into an FFT algorithm and perform FFT on the audio signals to obtain an FFT result. For example, when audio signal sampled by 8192 sample points (which may be considered as real-number sample points) are buffered, the obtained FFT result has a length of (8192/2)+1=4097, that is, 4097 complex numbers.

It should be noted that the FFT is performed by using an real discrete Fourier transform (RDFT) algorithm. The RDFT algorithm is a type of FFT and specifically used to sample real numbers in a time domain and convert them into complex numbers in a frequency domain. After N real numbers are subjected to RDFT, (N/2)+1 complex numbers will be obtained. Each complex number is subjected to a modulo operation, and (N/2)+1 real numbers will be then obtained, which means the amplitudes of (N/2)+1 frequency points. Each amplitude is calculated in log 10(X), where X represents the amplitude, and a power spectrum is then obtained.

Optionally, prior to the FFT, the audio signals may also be subjected to windowing. The corresponding processing may be described as follows:

windowing the sampled audio signal to obtain audio signal subjected to windowing; and performing the FFT on the audio signal subjected to windowing to obtain the FFT result.

Windowing refers to multiplication of an original integrand and a specific window function in Fourier integral. In consideration of the passband flatness and the stopband attenuation, a NUTTALL window may be selected as a window function for windowing.

During the practice, the terminal may acquire a pre-stored window function, window on the sampled audio signal by using the window function to obtain audio signal subjected to windowing, then input the audio signal subjected to windowing to FFT, and perform the FFT to obtain the FFT result.

It should be noted that the periodic extension is actually made in the FFT, this is because the data is processed by the terminal within a limited period of time. In the FFT, the desired time is an integral from negative infinity to positive infinity, and thus needs to be extended, and the problem of spectral leakage will be then involved. Therefore, the audio signals need to be subjected to windowing to correct the problem of spectral leakage.

In step 103, according to the FFT result, if a first frequency point satisfying preset conditions is present, audio signal sampled at a preset number of sampling points are converted into audio signals of a plurality of frequency subbands having an equal width, and a target frequency subband to which the first frequency point belongs is determined.

Figure 2:
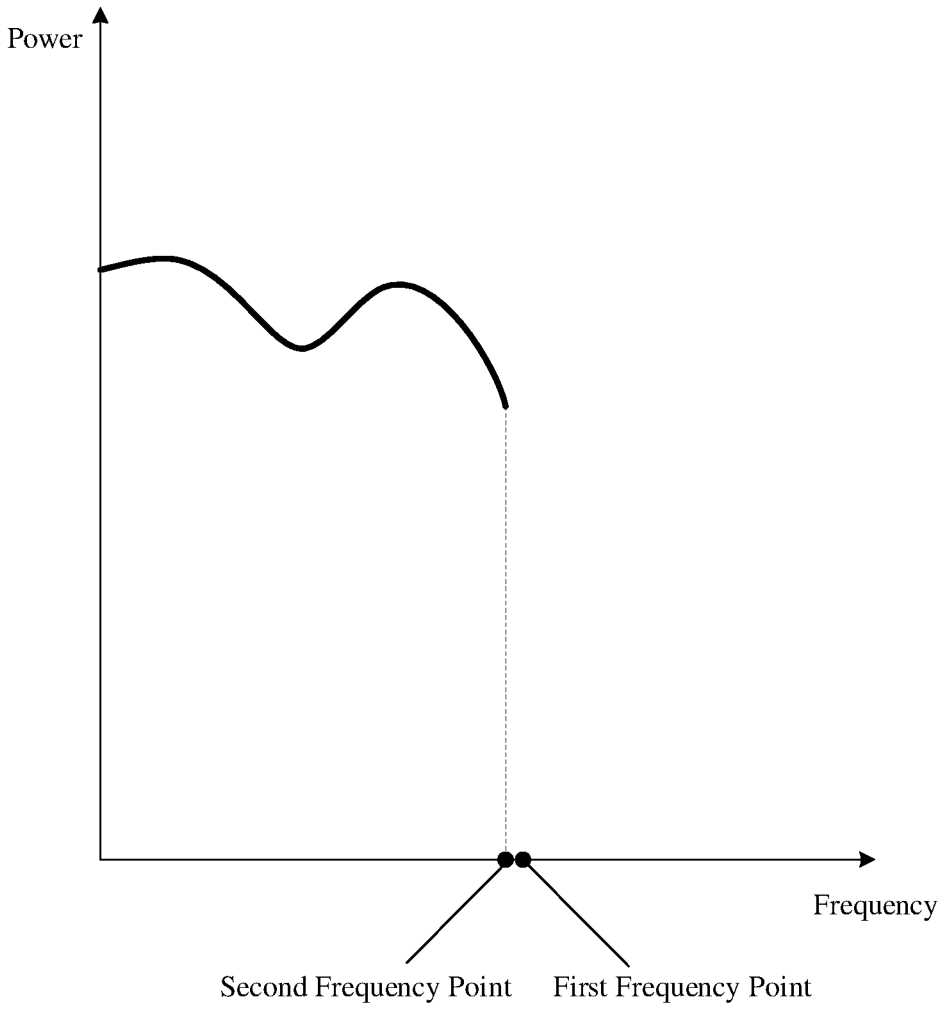
FIG. 2 is a schematic diagram of filtered frequency points as provided by an embodiment of the present disclosure.

As shown in FIG. 2, the preset conditions are that a difference between frequencies of the first frequency point and a second frequency point is less than a first preset value, a difference between powers of the first frequency point and the second frequency point is greater than a second preset value, a power of a frequency point having a frequency greater than the frequency of the first frequency point is zero, and the frequency of the second frequency point is less than the frequency of the first frequency point. The first preset value, such as 10 Hz, may be preset and stored in the terminal. The second preset value, such as 6 dB, may be preset and stored in the terminal.

During the practice, after obtaining the FFT result, if the FFT result is a frequency spectrum, the terminal may calculate a power spectrum (which may be the square of an amplitude corresponding to each frequency point) according to the frequency spectrum. In the power spectrum, each frequency point corresponds to one power. The terminal may then scan the power spectrum to find a cliff-like attenuation point of power, that is, to find a first frequency point satisfying the preset conditions. The preset conditions are that the frequency of the second frequency point is less than the frequency of the first frequency point; the difference between the frequencies of the first frequency point and the second frequency point is less than the first preset value, the difference between the powers of the first frequency point and the second frequency point is greater than the second preset value; and a power of a frequency point having a frequency greater than the frequency of the first frequency point is zero. The first frequency point may be referred to as a cliff-like attenuation point.

After finding out the first frequency point, the terminal may acquire the audio signal sampled at the preset number of sampling points in the preset step 101, then window the audio signals by using a window function (the window function may be a NUTTALL window function), and, after the windowing, convert the audio signal subjected to windowing into audio signals of frequency subbands having an equal width by using a preset modified discrete consine transform (MDCT) algorithm. The frequency subband in which the first frequency point is located is searched from these frequency subbands.

For example, the FFT result has a length of (8192/2)+1=4097, which may be expressed as SPEC[0, 1 . . . , 4096]. Assuming that the first frequency point is N, the power difference is SPEC[N−1]-SPEC[N]≥a second preset value, and SPEC [N+1 . . . 4096] are all 0. The frequency of the first frequency point may be expressed as N*(4097/(sampling rate/2)) in Hz. 4096 frequency subbands may be obtained through the MDCT algorithm, each frequency subband being equal in width. In addition, 4096 subbands are equally divided (sampling rate/2) in Hz. The frequency subbands may be named SUBBAND[0 . . . 4095]. It is assumed that the frequency subband including the first frequency point is N, the frequency range of the SUBBAND[N] frequency subband includes the frequency of the first frequency point.

It should be noted that the method of obtaining the frequency subbands by using the MDCT algorithm is merely an exemplary form, and frequency subbands may also be obtained by using a polyphase filter.

It should also be noted that the first frequency point is actually a frequency point having the smallest frequency among the filtered frequency points in the course of compression.

In step 104, according to the audio signal of a previous frequency subband of the target frequency subband, the audio signal of the target frequency subband and the audio signals of the frequency subbands after the target frequency subband in the plurality of frequency subbands are recovered.

During the practice, after the target frequency subband is found out, the previous frequency subband of the target frequency subband may be determined, the previous frequency subband being a frequency subband having a frequency endpoint value less than a frequency endpoint value of the target frequency subband and having the smallest difference from the frequency endpoint value of the target frequency subband. The audio signal of the previous frequency subband is then acquired. The audio signal of the target frequency subband and the audio signals of the frequency subbands after the target frequency subband in the plurality of frequency subbands are recovered.

The recovery process may be as follows:

It is assumed that the frequency subband containing the first frequency point is N, SUBBAND[K]=SUBBAND[K−1]*(SQRT(2)/2) may be used, where N≤K≤4095, and SQRT indicating square root. It may be seen that the audio signal of the first frequency subband is SUBBAND[N]=SUBBAND[N−1]*(SQRT(2)/2), and the audio signal of a frequency subband next to the first frequency subband is SUBBAND[N+1]=SUBBAND[N]*(SQRT(2)/2). It may be seen that the audio signal of the $N^{th}$ frequency subband is determined by using the audio signal of the $(N-1)^{th}$ frequency subband, and the audio signal of the $(N+1)^{th}$ frequency subband is determined by using the audio signal of the $N^{th}$ frequency subband. The audio signal of the $N^{th}$ frequency subband and the audio signal of each of the subsequent frequency subbands are calculated in turn. In this way, the audio signal of the target frequency subband and the audio signals of the frequency subbands after the target frequency subband may be recovered.

In step 105, the audio signals of the frequency subbands before the target frequency subband in the plurality of frequency subbands, the audio signal of the target frequency subband, and the audio signals of the frequency subbands after the target frequency subband in the plurality of frequency subbands are synthesized.

During the practice, after recovering the audio signal of the target frequency subband and the audio signals of the audio subbands after the target frequency subband, the terminal may input the audio signals of the frequency subbands before the target frequency subband in the plurality of frequency subbands, the audio signal of the target frequency subband, and the audio signals of the frequency subbands after the target frequency subband in the plurality of frequency subbands to an inverse MDCT algorithm (since the frequency subbands are equally divided by using the MDCT algorithm earlier, the inverse MDCT algorithm is used here) to obtain the synthesized audio signal, these synthesized audio signal including high-frequency signals.

In step 106, the synthesized audio signal is separated according to the first frequency point to obtain high-frequency signals and low-frequency signals; and the high-frequency signals are subjected to phase recovery.

A frequency of each of the low-frequency signals is less than the frequency of the first frequency point, and a frequency of each of the high-frequency signals is greater than or equal to the frequency of the first frequency point.

During the practice, the terminal may separate the synthesized audio signal according to the first frequency point to obtain audio signals (which may be referred to as high-frequency signals) each having a frequency greater than the frequency of the first frequency point and audio signals (which may be referred to as low-frequency signals) each having a frequency less than the frequency of the first frequency point.

Since the audio signal of the $N^{th}$ frequency subband is determined in step 105 by using the audio signal of the $(N-1)^{th}$ frequency subband, the phase of the audio signal of the $N^{th}$ frequency subband is the same as the phase of the audio signal of the $(N-1)^{th}$ frequency subband, it is also necessary to correct the phases of the high-frequency signals. Therefore, the high-frequency signals may be subjected to phase recovery to obtain high-frequency signals subjected to phase recovery.

Optionally, the high-frequency signals and the low-frequency signals may be separated by a filter. The corresponding processing may be as follows:

The synthesized audio signal are subjected to linear high-pass filtering to obtain high-frequency signals, and the synthesized audio signal are subjected to linear low-pass filtering to obtain low-frequency signals.

A frequency of the signal subjected to linear high-pass filtering is greater than or equal to the frequency of the first frequency point, and a frequency of the signal subjected to low-pass filtering is less than the frequency of the first frequency point.

During the practice, the terminal may input the synthesized audio signal into a preset linear high-pass filtering algorithm, so that the high-frequency signals pass, and the low-frequency signals are filtered, thereby obtaining the high-frequency signals. In addition, the synthesized audio signal may be input into a preset linear low-pass filtering algorithm, so that the low-frequency signals pass, and the high-frequency signals are filtered, thereby obtaining the low-frequency signals.

It should be noted that the linear high-pass filtering algorithm and the linear low-pass filtering algorithm may be an algorithm that implements a function of a finite impulse response (FIR) linear filter and is designed by using a window function method, respectively. A NUTTALL window may be selected as a window function. The length may be one eighth of the preset number in step 101 minus one.

In addition, when linear high-pass filtering is performed, the terminal may be connected with a linear high-pass filter and a linear low-pass filter, and input the synthesized audio signal to the linear high-pass filter, such that the high-frequency signals pass, and the low-frequency signals are filtered, thereby obtaining high-frequency signals, and the high-frequency signals are then returned to the terminal. In addition, the terminal may input the synthesized audio signal into a preset linear low-pass filter, such that the low-frequency signals pass, and the high-frequency signals are filtered, thereby obtaining low-frequency signals, and the low-frequency signals are then returned to the terminal.

It should be noted that the linear high-pass filter and the linear low-pass filter may also be FIR linear filters designed by using a window function method.

Optionally, the high-frequency signals are subjected to phase recovery by using a filtering manner. The corresponding processing may be as follows:

the high-frequency signals are subjected to all-pass biquad infinite impulse response (IIR) filtering to obtain high-frequency signals subjected to phase recovery.

During the practice, a common conductive wire transmits a group extension characteristic of audio analog signals (i.e., the higher the frequency of the audio signal, the larger the phase offset). The terminal may input the high-frequency signals into an all-pass biquad IIR filtering algorithm. The all-pass biquad IIR filtering algorithm may perform nonlinear phase offset on the high-frequency signals to obtain high-frequency signals subjected to phase recovery.

In addition, when performing phase recovery, the terminal may also be connected with an all-pass biquad IIR filter, and transmit the high-frequency signals to the all-pass biquad IIR filter, such that the biquad IIR filter performs nonlinear phase offset on the high-frequency signals to obtain high-frequency signals subjected to phase recovery, and the high-frequency signals are then returned to the terminal.

Optionally, the all-pass biquad IIR filtering algorithm has different coefficients for different sampling rates. In the embodiment of the present disclosure, a process for determining the coefficients of the all-pass biquad IIR filtering algorithm (the coefficients may be considered as non-normalized coefficients) is also provided:

a coefficient of the biquad IIR filtering is determined according to the frequency of the first frequency point and the sampling rates.

The non-normalized coefficients of the biquad IIR filtering algorithm are generally a0, a1, a2, b0, b1, b2. The frequency response curve and gain of the biquad IIR filtering algorithm may be determined according to these coefficients.

During the practice, in the calculation process, it may be first calculated:

$$G=\tan(\mathrm{PI}*(F/FS)) \tag{1}$$

In the formula (1), tan represents a calculated tangent value; PI represents pi; F represents the frequency of the first frequency point; and FS represents the sampling rate.

It Is Then Calculated:

$$K=1/(1+(G*\mathrm{SQRT}(2))+G2) \tag{2}$$

In the formula (2), SQRT represents square root; and G is equal to G in the formula (1).

It Is Next Calculated:

$$B0=(1-(G*\mathrm{SQRT}(2))+G2)*K \tag{3}$$

In the formula (3), G is equal to G in the formula (1); SQRT represents square root; and K is equal to K in the formula (2).

It Is Then Calculated:

$$B1=2*(G2-1)*K \tag{4}$$

In the formula (4), G is equal to G in the formula (1), and K is equal to K in the formula (1).

Then, B1 is assigned to A1, i.e., A1=B1, and next, B0 is assigned to A2, i.e., A2=B0.

The above-mentioned a0, a1, a2, b0, b1, and b2 may be equal to 1, A1, A2, B0, B1, and 1 respectively.

In this way, the non-normalized coefficients of the all-pass biquad IIR filtering algorithm may be obtained, and may be used in the course of performing phase recovery.

It should be noted that the function implemented by the biquad IIR filtering algorithm is the same as the function implemented by the biquad IIR filter. The biquad IIR filter is a commonly used IIR filter.

In step 107, the high-frequency signals subjected to phase recovery and the low-frequency signals are superimposed to obtain sampled audio signal in which the high-frequency signals are recovered.

During the practice, the terminal may superimpose the high-frequency signals subjected to phase recovery and the low-frequency signals to obtain sampled audio signal in which the high-frequency signals are recovered.

Optionally, in step 103, if the first frequency point is not present, the following processing may be performed:

according to the FFT result, if the first frequency point is not present, converting the audio signal sampled at the preset number of sampling points into a plurality of frequency subbands having an equal width, and synthesizing the audio signals of the plurality of frequency subbands; separating the audio signal obtained by synthesizing the audio signals of the plurality of frequency subbands according to a preset third frequency point to obtain high-frequency signals and low-frequency signals; and superimposing the high-frequency signals and the low-frequency signals according to the preset third frequency point to obtain sampled audio signal.

The third frequency point may be a preset frequency point, and may be stored in the terminal, or may be a first frequency point determined based on audio signal sampled at a preset number of sampling points, which are buffered previously. For example, the audio signal sampled at the preset number of sampling points are available currently, which are buffered for the third time, the first frequency point may be determined based on the audio signal sampled at the preset number of sampling points, which are buffered for the second time.

During the practice, after obtaining the FFT result, if the FFT result is a frequency spectrum, the terminal may calculate a power spectrum according to the frequency spectrum. In the power spectrum, each frequency point corresponds to one power. The terminal may then scan the power spectrum to find a cliff-like attenuation point of power, that is, to find a first frequency point satisfying the preset conditions. If no first frequency point satisfying the preset conditions is present, the audio signal sampled at the preset number of sampling points may be input into an MDCT algorithm, and converted into audio signals of a plurality of frequency subbands having an equal width. Since the first frequency point is not present, the audio signals of the plurality of frequency subbands having an equal width may be input into an inverse MDCT algorithm to be synthesized, and the synthesized audio signal are obtained.

Then, the synthesized audio signal are subjected to linear high-pass filtering to obtain high-frequency signals, wherein the frequency of each of the high-frequency signals is greater than or equal to the frequency of the third frequency point. In addition, the synthesized audio signal are subjected to linear low-pass filtering to obtain low-frequency signals, wherein the frequency of each of the low-frequency signals is less than the frequency of the third frequency point.

The low-frequency signals and the high-frequency signals may then be superimposed to obtain the sampled audio signal.

Although the first frequency point is not present this time, in order to prevent a sudden change of the audio signals obtained by sampling for successive two times, the frequency subbands are separated first, and then subjected to synthesis and other processes.

It should be noted that, in the above process, for a compressed audio, the processing of the above steps 101 to 107 is performed every time the audio signals of a preset number of sampling points are sampled, until the entire compressed audio has been recovered.

It should be noted that the audio in the embodiment of the present disclosure may be any audio format, such as MP3, AAC (Advanced Audio Coding, WMA (Windows Media Audio)), or the like. In addition, in the present disclosure, the data amount of the audio signal which is processed at a time is adjusted by adjusting the preset number in the step 101, so as to be applicable to platforms having different calculation powers, and platforms having ultralow power consumption and weak computing power.

In an embodiment of the present disclosure, in case of an audio with a lossy format, after audio signal sampled at a preset number of sampling points are buffered each time, the sampled audio signal are subjected to FFT to obtain an FFT result. According to the FFT result, if a first frequency point satisfying preset conditions is present, the audio signal sampled at the preset number of sampling points are converted into audio signals of a plurality of frequency subbands having an equal width. A target frequency subband including the first frequency point is determined. Then, based on the audio signal of a previous frequency subband of the target frequency subband, the audio signal of the target frequency subband in the plurality of frequency subbands and the audio signals of the frequency subbands after the target frequency subband are recovered. Next, the audio signals of the frequency subbands before the target frequency subband, the audio signal of the target frequency subband, and the audio signals of the frequency subbands after the target frequency subband in the plurality of frequency subbands are synthesized. The synthesized audio signal are separated according to the first frequency point to obtain high-frequency signals and low-frequency signals, and the high-frequency signals are subjected to phase recovery. The high-frequency signals subjected to phase recovery and the low-frequency signals are superimposed to obtain sampled audio signal in which the high-frequency signals are recovered. As such, since the high-frequency signals in the sampled audio signal may be recovered, the sampled audio signal are recovered as well. Therefore, the method for recovering audio signals is provided.

Figure 3:
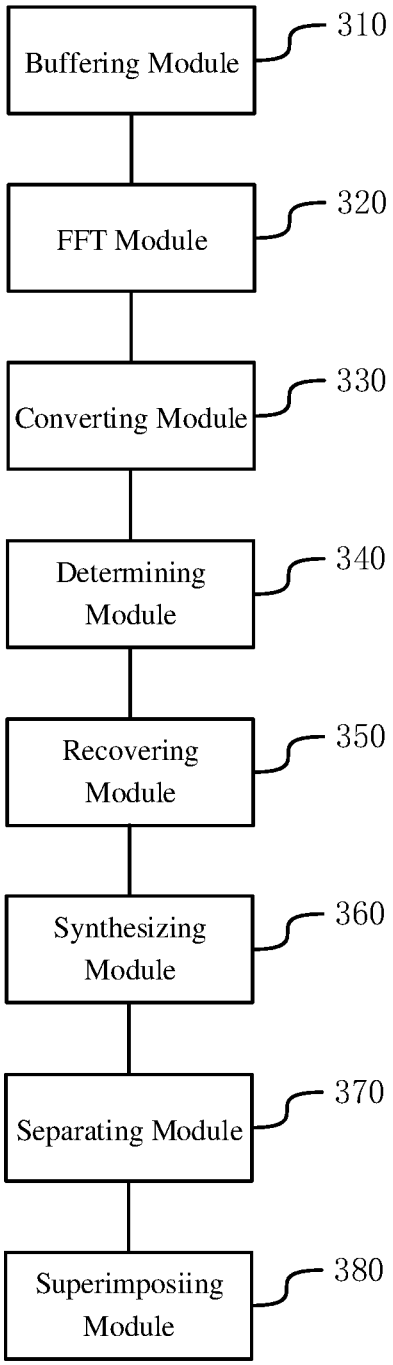
FIG. 3 is a schematic structural diagram of an apparatus for recovering audio signals as provided by an embodiment of the present disclosure.

Based on the same technical concept, an embodiment of the present disclosure further provides an apparatus for recovering audio signals. As shown in FIG. 3, the apparatus includes:

a buffering module 310, configured to buffer an audio signal sampled at a preset number of sampling points;

a FFT module 320, configured to perform FFT on the sampled audio signal to obtain an FFT result;

a converting module 330, configured to, according to the FFT result, if a first frequency point satisfying preset conditions is present, convert the audio signal sampled at the preset number of sampling points into audio signals of a plurality of frequency subbands having an equal width;

a determining module 340, configured to determine a target frequency subband to which the first frequency point belongs, wherein the preset conditions are that a difference between frequencies of the first frequency point and a second frequency point is less than a first preset value, a difference between powers of the first frequency point and the second frequency point is greater than a second preset value, a power of a frequency point having a frequency greater than the frequency of the first frequency point is zero, and the frequency of the second frequency point is less than the frequency of the first frequency point;

a recovering module 350, configured to, according to the audio signal of a previous frequency subband of the target frequency subband, the audio signal of the target frequency subband in the plurality of frequency subbands and the audio signals of the frequency subbands after the target frequency subband;

a synthesizing module 360, configured to synthesize the audio signals of the frequency subbands before the target frequency subband in the plurality of frequency subbands, the audio signal of the target frequency subband, and the audio signals of the frequency subbands after the target frequency subband in the plurality of frequency subbands;

a separating module 370, configured to separate the synthesized audio signal according to the first frequency point to obtain high-frequency signals and low-frequency signals, wherein the recovering module 350 is further configured to perform phase recovery on the high-frequency signals; and a superimposing module 380, configured to superimpose the high-frequency signals subjected to phase recovery and the low-frequency signals to obtain sampled audio signal in which the high-frequency signals are restored.

Optionally, the converting module 330 is further configured to, according to the FFT result, if the first frequency point is not present, convert the audio signal sampled at the preset number of sampling points into a plurality of frequency subbands having an equal width;

the synthesizing module 360 is further configured to synthesize the audio signals of the plurality of frequency subbands;

the separating module 370 is further configured to separate the audio signal obtained by synthesizing the audio signals of the plurality of frequency subbands according to a preset third frequency point to obtain high-frequency signals and low-frequency signals; and the superimposing module 380 is further configured to superimpose the high-frequency signals and the low-frequency signals according to the preset third frequency point to obtain the sampled audio signal.

Optionally, the separating module 370 is configured to:

perform linear high-pass filtering on the synthesized audio signal to obtain the high-frequency signals, and perform linear low-pass filtering on the synthesized audio signal to obtain the low-frequency signals, wherein the frequency of each of the signals subjected to linear high-pass filtering is greater than or equal to the frequency of the first frequency point, and the frequency of each of the signals subjected to linear low-pass filtering is less than the frequency of the first frequency point.

Optionally, the recovering module 350 is configured to:

perform all-pass biquad IIR filtering on the high-frequency signals to obtain high-frequency signals subjected to phase recovery.

Optionally, the determining module 340 is further configured to:

determine a coefficient of the biquad IIR filtering according to the frequency of the first frequency point and sampling rates.

Figure 4:
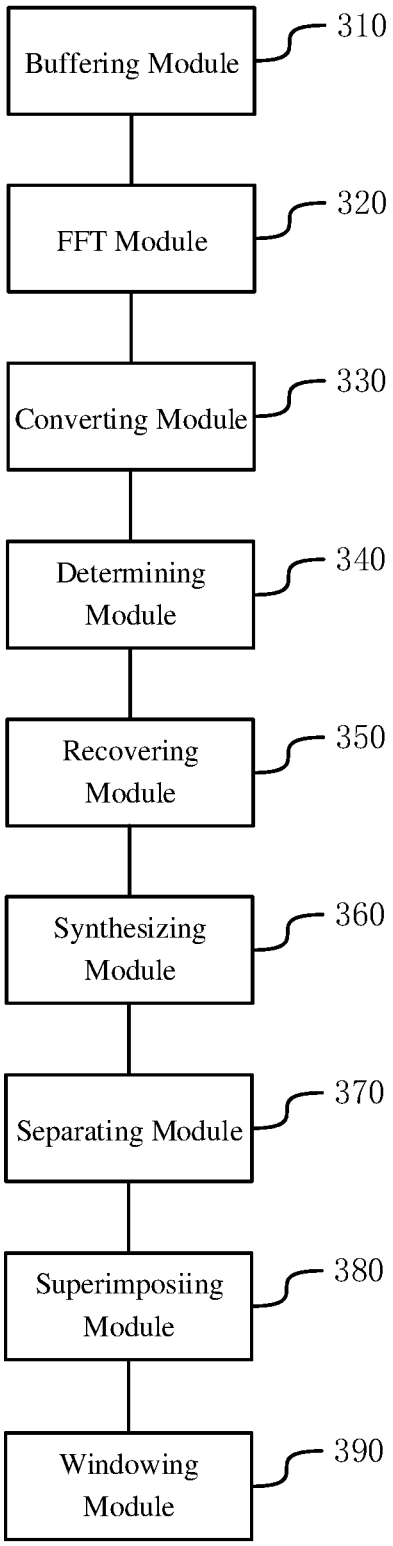
FIG. 4 is a schematic structural diagram of an apparatus for recovering audio signals as provided by an embodiment of the present disclosure.

Optionally, as shown in FIG. 4, the apparatus further includes:

a windowing module 390 configured to, prior to the performing FFT on the sampled audio signal to obtain an FFT result, window the sampled audio signal to obtain audio signal subjected to windowing; and the FFT module 320 is configured to:

perform the FFT on the audio signal subjected to windowing to obtain the FFT result.

In an embodiment of the present disclosure, in case of an audio with a lossy format, after audio signal sampled at a preset number of sampling points is buffered each time, the sampled audio signal are subjected to FFT to obtain an FFT result. According to the FFT result, if a first frequency point satisfying preset conditions is present, the audio signal sampled at the preset number of sampling points are converted into audio signals of a plurality of frequency subbands having an equal width. A target frequency subband including the first frequency point is determined. Then, based on the audio signal of a previous frequency subband of the target frequency subband, the audio signal of the target frequency subband in the plurality of frequency subbands and the audio signals of the frequency subbands after the target frequency subband are recovered. Next, the audio signals of the frequency subbands before the target frequency subband, the audio signal of the target frequency subband, and the audio signals of the frequency subbands after the target frequency subband in the plurality of frequency subbands are synthesized. The synthesized audio signal are separated according to the first frequency point to obtain high-frequency signals and low-frequency signals, and the high-frequency signals are subjected to phase recovery. The high-frequency signals subjected to phase recovery and the low-frequency signals are superimposed to obtain sampled audio signal in which the high-frequency signals are recovered. As such, since the high-frequency signals in the sampled audio signal may be recovered, the sampled audio signal are recovered as well. Therefore, the method for recovering audio signals is provided.

It should be noted that, when recovering audio signals, the apparatus for recovering audio signals is only illustrated by taking division of the all functional module as an example. While in a practical application, the above functions may be assigned to different modules to be achieved according to needs. That is, an internal structure of the terminal may be divided into the different functional modules, so as to achieve all or part of the functions described above. In addition, the apparatus for live broadcasting and the method for live broadcasting provided by the forging embodiments belong to the same concept. Specific implementation processes of the apparatus may refer to the embodiments of the method, and details thereof will not be repeated herein.

Figure 5:
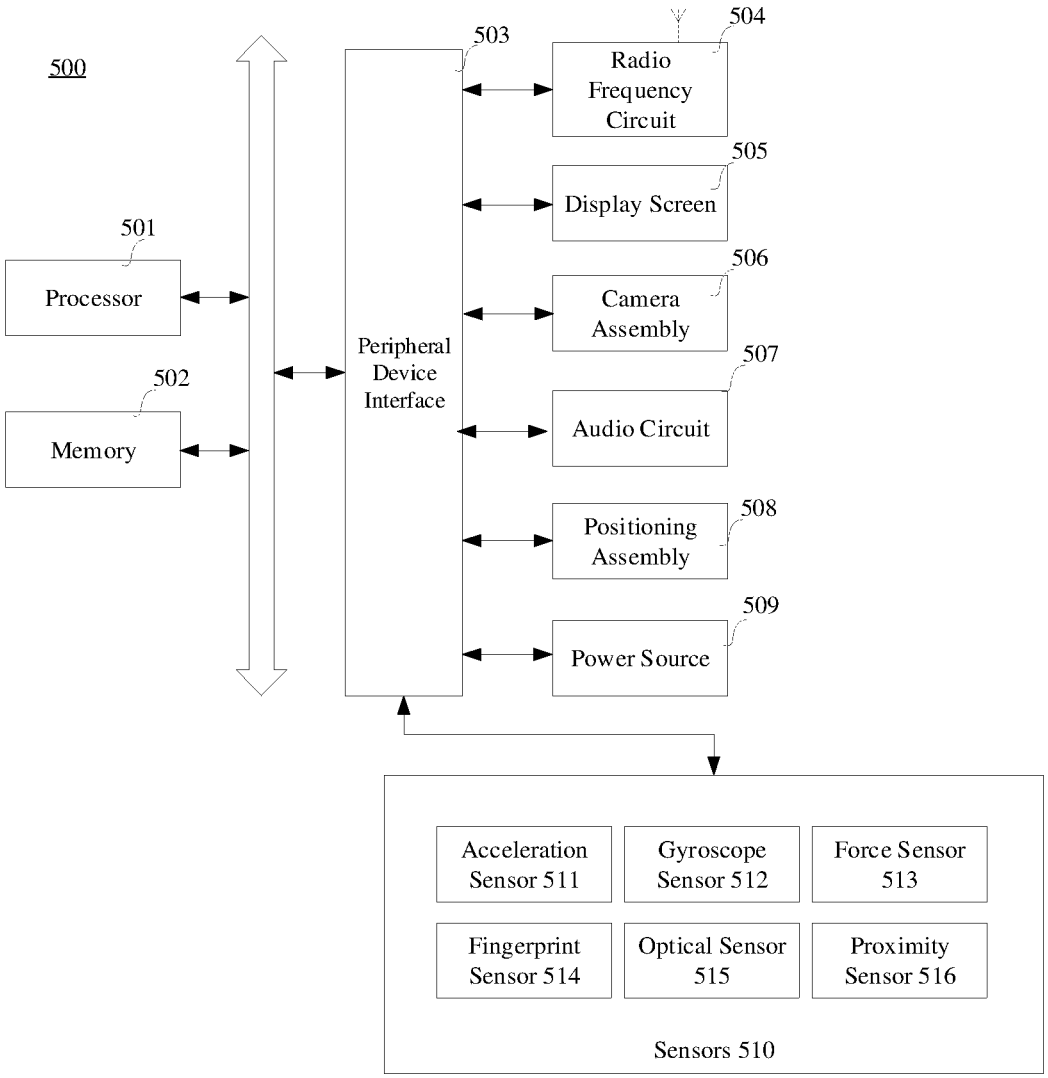
FIG. 5 is a schematic structural diagram of a terminal as provided by an embodiment of the present disclosure.

FIG. 5 is a structural block diagram of a terminal 500 according to an exemplary embodiment of the present disclosure. The terminal 500 may be a smart phone, a tablet computer, a Moving Picture Experts Group Audio Layer III (MP3) player, a Moving Picture Experts Group Audio Layer IV (MP4) player, or a laptop or desktop computer. The terminal 500 may also be referred to as a user equipment, a portable terminal, a laptop terminal, a desktop terminal, or the like Generally, the terminal 500 includes a processor 501 and a memory 502.

The processor 501 may include one or more processing cores, such as a 4-core processor, an 8-core processor, or the like. The processor 501 may be practiced by using at least one of hardware forms in a digital signal processor (DSP), a field-programmable gate array (FPGA) and a programmable logic array (PLA). The processor 501 may also include a main processor and a co-processor. The main processor is a processor for processing data in an awaken state, and is also called as a central processing unit (CPU). The co-processor is a low-power processor for processing data in a standby state. In some embodiments, the processor 501 may be integrated with a graphics processing unit (GPU) which is responsible for rendering and drawing of content required to be displayed by a display. In some embodiments, the processor 501 may also include an artificial intelligence (AI) processor for processing a calculation operation related to machine learning.

The memory 502 may include one or more computer-readable storage media which may be non-transitory. The memory 502 may also include a high-speed random-access memory, as well as a non-volatile memory, such as one or more disk storage devices and flash storage devices. In some embodiments, the non-transitory computer-readable storage medium in the memory 502 is configured to store at least one instruction which is executable by the processor 501 to implement the method for determining the karaoke singing score according to the embodiments of the present disclosure.

In some embodiments, the terminal 500 may optionally include a peripheral device interface 503 and at least one peripheral device. The processor 501, the memory 502 and the peripheral device interface 503 may be connected to each other via a bus or a signal line. The at least one peripheral device may be connected to the peripheral device interface 503 via a bus, a signal line or a circuit board. Specifically, the peripheral device includes at least one of a radio frequency circuit 504, a touch display screen 505, a camera assembly 506, an audio circuit 507, a positioning assembly 508 and a power source 509.

The peripheral device interface 503 may be configured to connect the at least one peripheral device related to input/output (I/O) to the processor 501 and the memory 502. In some embodiments, the processor 501, the memory 502 and the peripheral device interface 503 are integrated on the same chip or circuit board. In some other embodiments, any one or two of the processor 501, the memory 502 and the peripheral device interface 503 may be practiced on a separate chip or circuit board, which is not limited in this embodiment.

The radio frequency circuit 504 is configured to receive and transmit a radio frequency (RF) signal, which is also referred to as an electromagnetic signal. The radio frequency circuit 504 communicates with a communication network or another communication device via the electromagnetic signal. The radio frequency circuit 504 converts an electrical signal to an electromagnetic signal and sends the signal, or converts a received electromagnetic signal to an electrical signal. Optionally, the radio frequency circuit 504 includes an antenna system, an RF transceiver, one or a plurality of amplifiers, a tuner, an oscillator, a digital signal processor, a codec chip set, a subscriber identification module card or the like. The radio frequency circuit 504 may communicate with another terminal based on a wireless communication protocol. The wireless communication protocol includes, but not limited to: a metropolitan area network, generations of mobile communication networks (including 2G, 3G, 4G and 5G), a wireless local area network and/or a wireless fidelity (WiFi) network. In some embodiments, the radio frequency circuit 504 may further include a near field communication (NFC)-related circuits, which is not limited in the present disclosure.

The display screen 505 may be configured to display a user interface (UI). The UE may include graphics, texts, icons, videos and any combination thereof. When the display screen 505 is a touch display screen, the display screen 505 may further have the capability of acquiring a touch signal on a surface of the display screen 505 or above the surface of the display screen 505. The touch signal may be input to the processor 501 as a control signal, and further processed therein. In this case, the display screen 505 may be further configured to provide a virtual button and/or a virtual keyboard or keypad, also referred to as a soft button and/or a soft keyboard or keypad. In some embodiments, one display screen 505 may be provided, which is arranged on a front panel of the terminal 500. In some other embodiments, at least two display screens 505 are provided, which are respectively arranged on different surfaces of the terminal 500 or designed in a folded fashion. In still some other embodiments, the display screen 505 may be a flexible display screen, which is arranged on a bent surface or a folded surface of the terminal 500. Even, the display screen 505 may be further arranged to an irregular pattern which is non-rectangular, that is, a specially-shaped screen. The display screen 505 may be fabricated from such materials as a liquid crystal display (LCD), an organic light-emitting diode (OLED) and the like.

The camera assembly 506 is configured to capture an image or a video. Optionally, the camera assembly 506 includes a front camera and a rear camera. Generally, the front camera is arranged on a front panel of the terminal, and the rear camera is arranged on a rear panel of the terminal. In some embodiments, at least two rear cameras are arranged, which are respectively any one of a primary camera, a depth of field (DOF) camera, a wide-angle camera and a long-focus camera, such that the primary camera and the DOF camera are fused to implement the background virtualization function, and the primary camera and the wide-angle camera are fused to implement the panorama photographing and virtual reality (VR) photographing functions or other fused photographing functions. In some embodiments, the camera assembly 506 may further include a flash. The flash may be a single-color temperature flash or a double-color temperature flash. The double-color temperature flash refers to a combination of a warm-light flash and a cold-light flash, which may be used for light compensation under different color temperatures.

The audio circuit 507 may include a microphone and a speaker. The microphone is configured to capture an acoustic wave of a user and an environment, and convert the acoustic wave to an electrical signal and output the electrical signal to the processor 501 for further processing, or output to the radio frequency circuit 504 to implement voice communication. For the purpose of stereo capture or noise reduction, a plurality of such microphones may be provided, which are respectively arranged at different positions of the terminal 500. The microphone may also be a microphone array or an omnidirectional capturing microphone. The speaker is configured to convert an electrical signal from the processor 501 or the radio frequency circuit 504 to an acoustic wave. The speaker may be a traditional thin-film speaker, or may be a piezoelectric ceramic speaker. When the speaker is a piezoelectric ceramic speaker, an electrical signal may be converted to an acoustic wave audible by human beings, or an electrical signal may be converted to an acoustic wave inaudible by human beings for the purpose of ranging or the like. In some embodiments, the audio circuit 507 may further include a headphone plug.

The positioning assembly 508 is configured to determine a current geographical position of the terminal 500 to implement navigation or a local based service (LBS). The positioning assembly 508 may be the global positioning system (GPS) from the United States, the Beidou positioning system from China, the Grenas satellite positioning system from Russia or the Galileo satellite navigation system from the European Union.

The power source 509 is configured to supply power for the components in the terminal 500. The power source 509 may be an alternating current, a direct current, a disposable battery or a rechargeable battery. When the power source 509 includes a rechargeable battery, the rechargeable battery may support wired charging or wireless charging. The rechargeable battery may also support the supercharging technology.

In some embodiments, the terminal may further include one or a plurality of sensors 510. The one or plurality of sensors 510 include, but not limited to: an acceleration sensor 511, a gyroscope sensor 512, a pressure sensor 513, a fingerprint sensor 514, an optical sensor 515 and a proximity sensor 516.

The acceleration sensor 511 may detect accelerations on three coordinate axes in a coordinate system established for the terminal 500. For example, the acceleration sensor 511 may be configured to detect components of a gravity acceleration on the three coordinate axes. The processor 501 may control the touch display screen 505 to display the user interface in a horizontal view or a longitudinal view based on a gravity acceleration signal acquired by the acceleration sensor 511. The acceleration sensor 511 may be further configured to acquire motion data of a game or a user.

The gyroscope sensor 512 may detect a direction and a rotation angle of the terminal 500, and the gyroscope sensor 512 may collaborate with the acceleration sensor 511 to capture a 3D action performed by the user for the terminal 500. Based on the data acquired by the gyroscope sensor 512, the processor 501 may implement the following functions: action sensing (for example, modifying the UE based on an inclination operation of the user), image stabilization during the photographing, game control and inertial navigation.

The force sensor 513 may be arranged on a side frame of the terminal and/or on a lowermost layer of the touch display screen 505. When the force sensor 513 is arranged on the side frame of the terminal 500, a grip signal of the user against the terminal 500 may be detected, and the processor 501 implements left or right hand identification or perform a shortcut operation based on the grip signal acquired by the force sensor 513. When the force sensor 513 is arranged on the lowermost layer of the touch display screen 505, the processor 501 implement control of an operable control on the UI based on a force operation of the user against the touch display screen 505. The operable control includes at least one of a button control, a scroll bar control, an icon control, and a menu control.

The fingerprint sensor 514 is configured to acquire fingerprints of the user, and the processor 501 determines the identity of the user based on the fingerprints acquired by the fingerprint sensor 514, or the fingerprint sensor 514 determines the identity of the user based on the acquired fingerprints. When it is determined that the identify of the user is trustable, the processor 501 authorizes the user to perform related sensitive operations, wherein the sensitive operations include unlocking the screen, checking encrypted information, downloading software, paying and modifying settings and the like. The fingerprint sensor 514 may be arranged on a front face a back face or a side face of the terminal 500. When the terminal 500 is provided with a physical key or a manufacturer's logo, the fingerprint sensor 514 may be integrated with the physical key or the manufacturer's logo.

The optical sensor 515 is configured to acquire the intensity of ambient light. In one embodiment, the processor 501 may control a display luminance of the touch display screen 505 based on the intensity of ambient light acquired by the optical sensor 515. Specifically, when the intensity of ambient light is high, the display luminance of the touch display screen 505 is up-shifted; and when the intensity of ambient light is low, the display luminance of the touch display screen 505 is down-shifted. In another embodiment, the processor 501 may further dynamically adjust photographing parameters of the camera assembly 506 based on the intensity of ambient light acquired by the optical sensor.

The proximity sensor 516, also referred to as a distance sensor, is generally arranged on the front panel of the terminal 500. The proximity sensor 516 is configured to acquire a distance between the user and the front face of the terminal 500. In one embodiment, when the proximity sensor 516 detects that the distance between the user and the front face of the terminal 500 gradually decreases, the processor 501 controls the touch display screen 505 to switch from an active state to a rest state; and when the proximity sensor 516 detects that the distance between the user and the front face of the terminal 500 gradually increases, the processor 501 controls the touch display screen 505 to switch from the rest state to the active state.

A person skilled in the art may understand that the structure of the terminal as illustrated in FIG. 5 does not construe a limitation on the terminal 500. The terminal may include more components over those illustrated in FIG. 5, or combinations of some components, or employ different component deployments.

Persons of ordinary skill in the art can understand that all or part of the steps described in the above embodiments can be completed through hardware, or through relevant hardware instructed by applications stored in a non-transitory computer readable storage medium, such as a read-only memory, a disk or a CD.

Described above are merely exemplary embodiments of the present disclosure, and are not intended to limit the present disclosure. Within the spirit and principles of the disclosure, any modifications, equivalent substitutions or improvements are within the protection scope of the present disclosure.

What is claimed is:

1. A method for recovering audio signals, comprising:

determining a first frequency point in an audio signal having a high-frequency signal to be recovered by power spectrum scanning by:

buffering an audio signal which is sampled at a preset number of sampling points;

performing fast Fourier transform (FFT) on the sampled audio signal to obtain an FFT result; and according to the FFT result, finding the first frequency point satisfying preset conditions, wherein the preset conditions are that a difference between a frequency of the first frequency point and a frequency of a second frequency point is less than a first preset value, a difference between powers of the first frequency point and the second frequency point is greater than a second preset value, a power of a frequency point having a frequency greater than the frequency of the first frequency point is zero, and the frequency of the second frequency point is less than the frequency of the first frequency point, wherein the first frequency point is a frequency point having a minimum frequency of the high-frequency signal to be recovered in the audio signal;

among a plurality of frequency subbands having equal width of the audio signal having the high-frequency signal to be recovered, recovering, according to the audio signal of a previous frequency subband of a target frequency subband, the audio signal of the target frequency subband and the audio signals of the frequency subbands after the target frequency subband in the plurality of frequency subbands, wherein the target frequency subband is a frequency subband to which the first frequency point belongs;

synthesizing the audio signals of the frequency subbands before the target frequency subband in the plurality of frequency subbands, the audio signal of the target frequency subband, and the audio signals of the frequency subbands after the target frequency subband in the plurality of frequency subbands;

separating the synthesized audio signal according to the first frequency point to obtain high-frequency signals and low-frequency signals, and performing phase recovery on the high-frequency signals; and superimposing the high-frequency signals subjected to phase recovery and the low-frequency signals to obtain an audio signal in which the high-frequency signals are recovered.

2. The method according to claim 1, further comprising:

if the first frequency point is not present in the audio signal having the high-frequency signal to be recovered, converting the audio signal having the high-frequency signal to be recovered into a plurality of frequency subbands having an equal width, and synthesizing the audio signals of the plurality of frequency subbands;

separating the audio signal obtained by synthesizing the audio signals of the plurality of frequency subbands according to a preset third frequency point to obtain high-frequency signals and low-frequency signals; and superimposing the high-frequency signals and the low-frequency signals obtained by separating according to the preset third frequency point to obtain the audio signal in which the high-frequency signals are recovered.

3. The method according to claim 1, wherein separating the synthesized audio signal according to the first frequency point to obtain high-frequency signals and low-frequency signals comprises:

performing linear high-pass filtering on the synthesized audio signal to obtain the high-frequency signals, and performing linear low-pass filtering on the synthesized audio signal to obtain the low-frequency signals, wherein a frequency of each of the signals subjected to linear high-pass filtering is greater than or equal to the frequency of the first frequency point, and a frequency of each of the signals subjected to linear low-pass filtering is less than the frequency of the first frequency point.

4. The method according to claim 1, wherein performing phase recovery on the high-frequency signals comprises:

performing all-pass biquad infinite impulse response (IIR) filtering on the high-frequency signals to obtain the high-frequency signals subjected to phase recovery.

5. The method according to claim 4, further comprising:

determining a coefficient of the biquad IIR filtering according to the frequency of the first frequency point and sampling rates.

6. The method according to claim 1, wherein prior to the performing FFT on the sampled audio signal to obtain an FFT result, the method further comprises:

windowing the sampled audio signal to obtain audio signal subjected to windowing; and wherein performing FFT on the sampled audio signal to obtain an FFT result comprises:

performing the FFT on the audio signal subjected to windowing to obtain the FFT result.

7. A terminal, comprising a memory and a processor, wherein the memory is used to store at least one instruction, the processor is used to implement a method when executing the at least one instruction, and the method comprises:

determining a first frequency point in an audio signal having a high-frequency signal to be recovered by power spectrum scanning by:

buffering an audio signal which is sampled at a preset number of sampling points;

performing fast Fourier transform (FFT) on the sampled audio signal to obtain an FFT result; and according to the FFT result, finding the first frequency point satisfying preset conditions, wherein the preset conditions are that a difference between a frequency of the first frequency point and a frequency of a second frequency point is less than a first preset value, a difference between powers of the first frequency point and the second frequency point is greater than a second preset value, a power of a frequency point having a frequency greater than the frequency of the first frequency point is zero, and the frequency of the second frequency point is less than the frequency of the first frequency point, wherein the first frequency point is a frequency point having a minimum frequency of the high-frequency signal to be recovered in the audio signal;

among a plurality of frequency subbands having equal width of the audio signal having the high-frequency signal to be recovered, recovering, according to the audio signal of a previous frequency subband of a target frequency subband, the audio signal of the target frequency subband and the audio signals of the frequency subbands after the target frequency subband in the plurality of frequency subbands, wherein the target frequency subband is a frequency subband to which the first frequency point belongs;

synthesizing the audio signals of the frequency subbands before the target frequency subband in the plurality of frequency subbands, the audio signal of the target frequency subband, and the audio signals of the frequency subbands after the target frequency subband in the plurality of frequency subbands;

separating the synthesized audio signal according to the first frequency point to obtain high-frequency signals and low-frequency signals, and performing phase recovery on the high-frequency signals; and superimposing the high-frequency signals subjected to phase recovery and the low-frequency signals to obtain an audio signal in which the high-frequency signals are recovered.

8. The terminal according to claim 7, wherein the method further comprises:

if the first frequency point is not present in the audio signal having the high-frequency signal to be recovered, converting the audio signal having the high-frequency signal to be recovered into a plurality of frequency subbands having an equal width, and synthesizing the audio signals of the plurality of frequency subbands;

separating the audio signal obtained by synthesizing the audio signals of the plurality of frequency subbands according to a preset third frequency point to obtain high-frequency signals and low-frequency signals; and superimposing the high-frequency signals and the low-frequency signals obtained by separating according to the preset third frequency point to obtain the audio signal in which the high-frequency signals are recovered.

9. The terminal according to claim 7, wherein separating the synthesized audio signal according to the first frequency point to obtain high-frequency signals and low-frequency signals comprises:

performing linear high-pass filtering on the synthesized audio signal to obtain the high-frequency signals, and performing linear low-pass filtering on the synthesized audio signal to obtain the low-frequency signals, wherein a frequency of each of the signals subjected to linear high-pass filtering is greater than or equal to the frequency of the first frequency point, and a frequency of each of the signals subjected to linear low-pass filtering is less than the frequency of the first frequency point.

10. The terminal according to claim 7, wherein performing phase recovery on the high-frequency signals comprises:

performing all-pass biquad infinite impulse response (IIR) filtering on the high-frequency signals to obtain the high-frequency signals subjected to phase recovery.

11. The terminal according to claim 10, wherein the method further comprises:

determining a coefficient of the biquad IIR filtering according to the frequency of the first frequency point and sampling rates.

12. The terminal according to claim 7, wherein prior to the performing FFT on the sampled audio signal to obtain an FFT result, the method further comprises:

windowing the sampled audio signal to obtain audio signal subjected to windowing; and wherein performing FFT on the sampled audio signal to obtain an FFT result comprises:

performing the FFT on the audio signal subjected to windowing to obtain the FFT result.

13. A non-transitory computer-readable storage medium storing at least one instruction, wherein the at least one instruction, when being executed by a processor, implements a method, and the method comprises:

determining a first frequency point in an audio signal having a high-frequency signal to be recovered by power spectrum scanning by:

buffering an audio signal which is sampled at a preset number of sampling points;

performing fast Fourier transform (FFT) on the sampled audio signal to obtain an FFT result; and according to the FFT result, finding the first frequency point satisfying preset conditions, wherein the preset conditions are that a difference between a frequency of the first frequency point and a frequency of a second frequency point is less than a first preset value, a difference between powers of the first frequency point and the second frequency point is greater than a second preset value, a power of a frequency point having a frequency greater than the frequency of the first frequency point is zero, and the frequency of the second frequency point is less than the frequency of the first frequency point, wherein the first frequency point is a frequency point having a minimum frequency of the high-frequency signal to be recovered in the audio signal;

among a plurality of frequency subbands having equal width of the audio signal having the high-frequency signal to be recovered, recovering, according to the audio signal of a previous frequency subband of a target frequency subband, the audio signal of the target frequency subband and the audio signals of the frequency subbands after the target frequency subband in the plurality of frequency subbands, wherein the target frequency subband is a frequency subband to which the first frequency point belongs;

synthesizing the audio signals of the frequency subbands before the target frequency subband in the plurality of frequency subbands, the audio signal of the target frequency subband, and the audio signals of the frequency subbands after the target frequency subband in the plurality of frequency subbands;

separating the synthesized audio signal according to the first frequency point to obtain high-frequency signals and low-frequency signals, and performing phase recovery on the high-frequency signals; and superimposing the high-frequency signals subjected to phase recovery and the low-frequency signals to obtain an audio signal in which the high-frequency signals are recovered.

14. The storage medium according to claim 13, wherein the method further comprises:

if the first frequency point is not present in the audio signal having the high-frequency signal to be recovered, converting the audio signal having the high-frequency signal to be recovered into a plurality of frequency subbands having an equal width, and synthesizing the audio signals of the plurality of frequency subbands;

separating the audio signal obtained by synthesizing the audio signals of the plurality of frequency subbands according to a preset third frequency point to obtain high-frequency signals and low-frequency signals; and superimposing the high-frequency signals and the low-frequency signals obtained by separating according to the preset third frequency point to obtain the audio signal in which the high-frequency signals are recovered.

15. The storage medium according to claim 13, wherein separating the synthesized audio signal according to the first frequency point to obtain high-frequency signals and low-frequency signals comprises:

performing linear high-pass filtering on the synthesized audio signal to obtain the high-frequency signals, and performing linear low-pass filtering on the synthesized audio signal to obtain the low-frequency signals, wherein a frequency of each of the signals subjected to linear high-pass filtering is greater than or equal to the frequency of the first frequency point, and a frequency of each of the signals subjected to linear low-pass filtering is less than the frequency of the first frequency point.

16. The storage medium according to claim 13, wherein performing phase recovery on the high-frequency signals comprises:

performing all-pass biquad infinite impulse response (IIR) filtering on the high-frequency signals to obtain the high-frequency signals subjected to phase recovery.

17. The storage medium according to claim 16, wherein the method further comprises:

determining a coefficient of the biquad IIR filtering according to the frequency of the first frequency point and sampling rates.

18. The storage medium according to claim 13, wherein prior to performing FFT on the sampled audio signal to obtain the FFT result, the method further comprises:

windowing the sampled audio signal to obtain an audio signal subjected to windowing; and wherein performing FFT on the sampled audio signal to obtain the FFT result comprises:

performing the FFT on the audio signal subjected to windowing to obtain the FFT result.

* * * * *